US006257926B1

(12) United States Patent
Hwang

(10) Patent No.: US 6,257,926 B1
(45) Date of Patent: Jul. 10, 2001

(54) GUIDING POST WITH PRESS-FIT ARRANGEMENT

(75) Inventor: Jenq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/599,063

(22) Filed: Jun. 21, 2000

(51) Int. Cl.[7] ..... H01R 13/60; H01R 13/66
(52) U.S. Cl. ..... 439/567; 439/571
(58) Field of Search ..... 439/326, 567, 439/569, 565, 637, 557, 571

(56) References Cited

U.S. PATENT DOCUMENTS 4,477,142 * 10/1984 Cooper et al. ..... 439/567
5,052,936 * 10/1991 Biechler et al. ..... 439/60
5,178,561 * 1/1993 Lindeberg et al. ..... 439/571
5,201,661 * 4/1993 Ii ..... 439/79
5,257,947 * 11/1993 Scheer et al. ..... 439/567
5,702,271 * 12/1997 Steinman ..... 439/676
5,810,623 * 9/1998 Regnier et al. ..... 439/637

* cited by examiner

*Primary Examiner*—Tulsidas Patel
*Assistant Examiner*—Hae Moon Hyeon
(74) *Attorney, Agent, or Firm*—Wei Te Chung

(57) ABSTRACT

An electrical system comprises a printed circuit board having at least a pair of mounting holes. A connector includes a housing with a pair of flanges extending outward from the housing. The housing defines an elongate slot within a plurality of terminal passageways formed in inner walls of the slot. A pair of guiding post extends downward from the flanges. Each guiding post includes a pair of mounting legs spaced apart from each other with a gap therebetween. Wherein each mounting leg including a chamfered end to guide the mounting leg into the hole defined in a printed circuit board.

5 Claims, 4 Drawing Sheets

GUIDING POST WITH PRESS-FIT ARRANGEMENT

FIELD OF THE INVENTION

The present invention relates to a guiding post, and more particularly, to a guiding post with a press-fit arrangement which can fixedly attach a connector to a printed circuit board.

DESCRIPTION OF THE PRIOR ART

In order to fixedly attach an electrical connector to a printed circuit board for further soldering process, board locks and guiding post are provided on the connector housing. The board locks are made from metal sheet which can fixedly engage to an inner wall of the hole or a lower edge of the hole. Accordingly, the connector can be fixedly attached to the printed circuit board for soldering.

Generally, the guiding post is integrally formed with a housing of the connector and which is merely used for guiding terminal tails/legs into corresponding holes. The guiding post does not facilitate any engagement with the corresponding hole.

SUMMARY OF THE INVENTION

It is an objective of this invention to provide a guiding post with a press-fit arrangement which can fixedly attach a connector to a printed circuit board.

In order to achieve the objective set forth, an electrical system in accordance with the present invention comprises a printed circuit board having at least a pair of mounting holes. A connector includes a housing with a pair of flanges extending outward from the housing. The housing defines an elongate slot with a plurality of terminal passageways formed in inner walls of the slot. A pair of guiding post extends downward from the flanges. Each guiding post includes a pair of mounting legs spaced apart from each other with a gap therebetween. Wherein each mounting leg including a chamfered end to guide the mounting leg into the hole defined in a printed circuit board.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
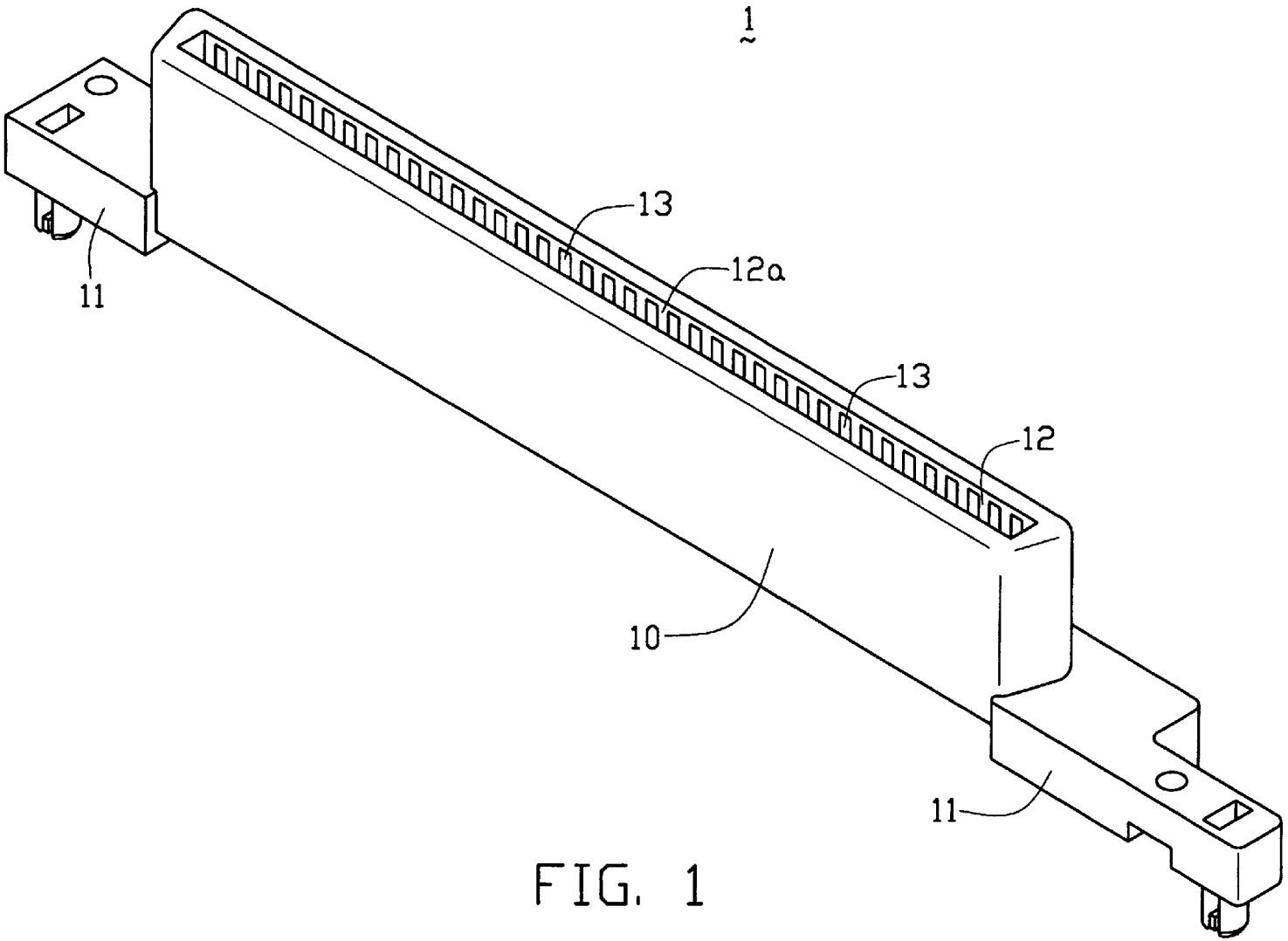
FIG. 1 is a perspective view of an electrical connector in accordance with the present invention.
Figure 2:
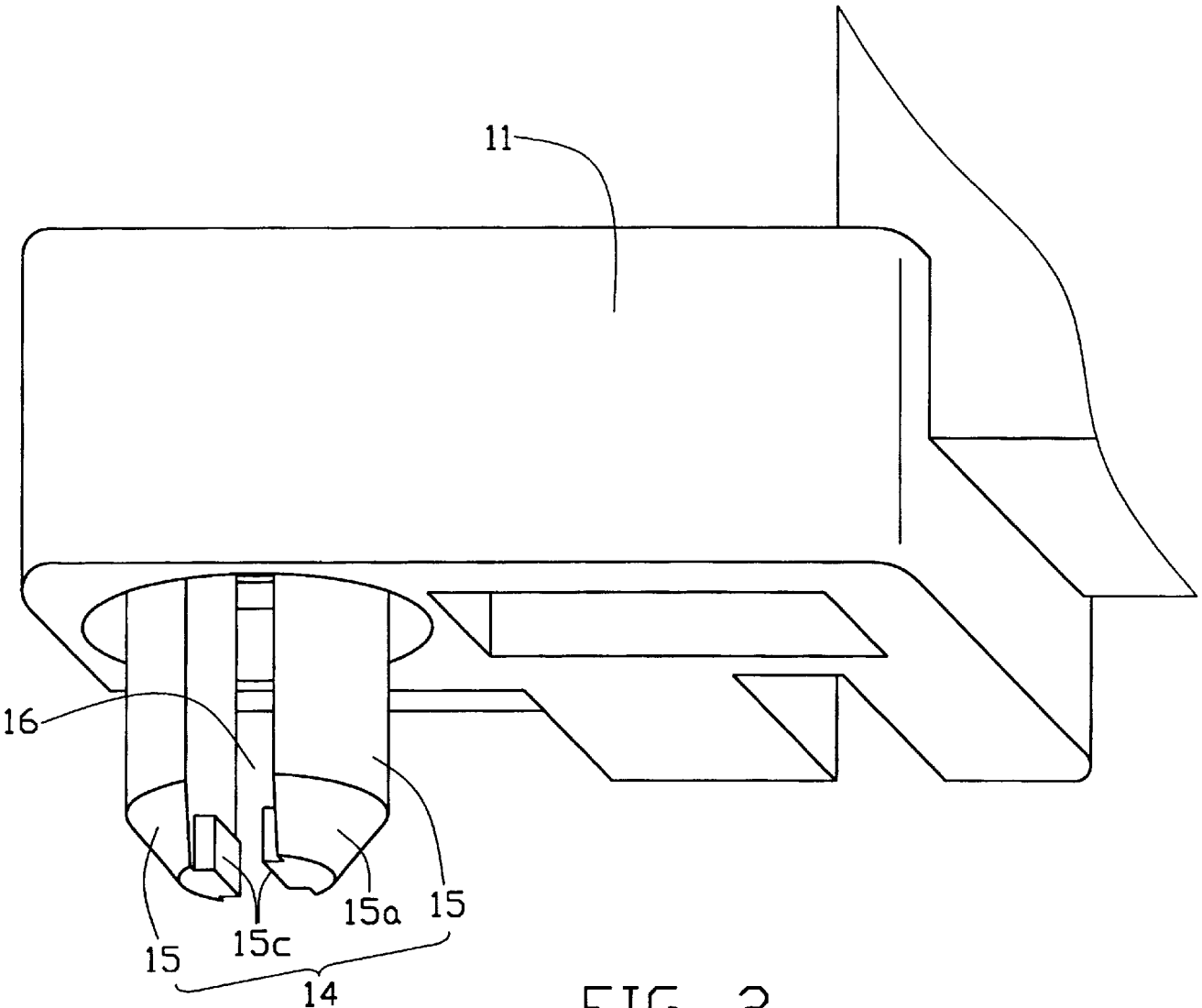
FIG. 2 is an enlarged partial view of a guiding post in accordance with the present invention.
Figure 3:
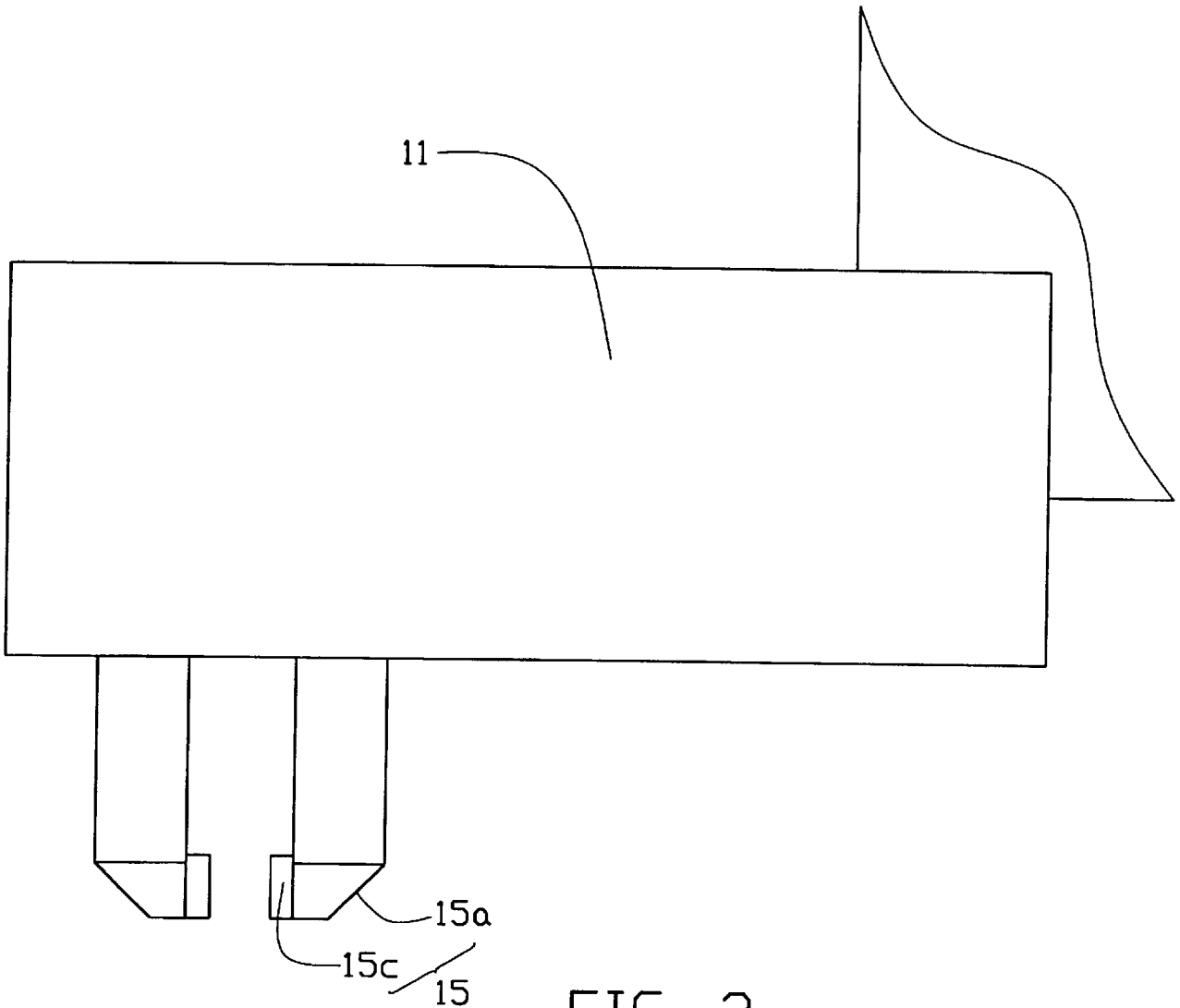
FIG. 3 is a side view of the guiding post of FIG. 3.
Figure 4:
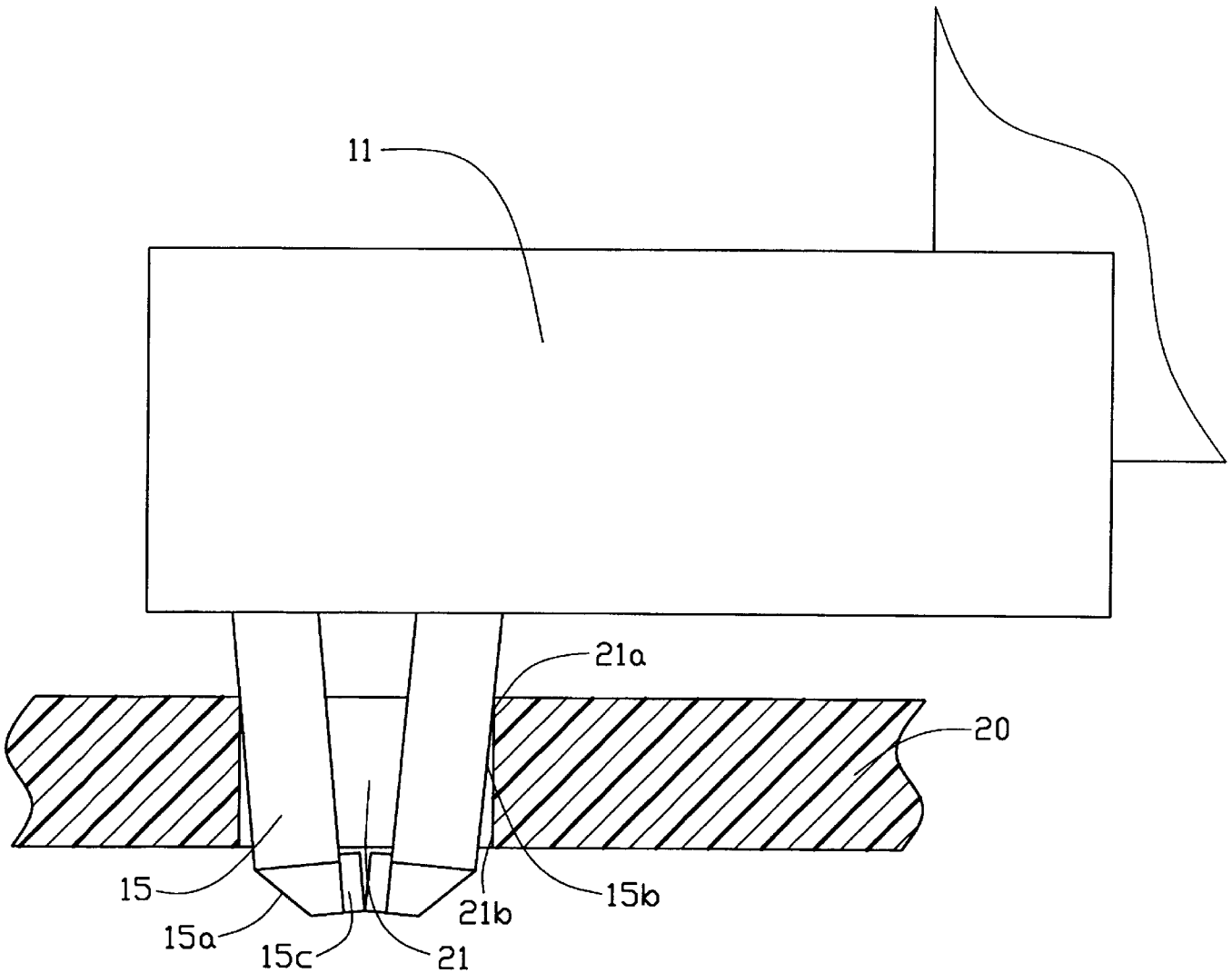
FIG. 4 is a cross sectional view showing the guiding post is fixedly retained within a hole of a printed circuit board.

Referring to FIGS. 1 to 4, a connector 1 in accordance with the present invention includes a housing 10 with a pair of flanges 11 extending outward therefrom. The housing 10 defines an elongate slot 12 with a plurality of terminal passageways 13 formed in inner walls 12*a* of the slot 12. Each terminal passageway 13 may receive a terminal (not shown) therein.

A pair of guiding posts 14 extending downward from the flanges 11. Each guiding post 14 includes a pair of mounting legs 15 spaced apart from each other with a gap 16 therebetween. Each mounting leg 15 includes a chamfered end 15*a* to guide the mounting leg 15 into a hole 21 defined in a printed circuit board 20.

The mounting legs 15 jointly define a first outer diameter which is larger than said hole 21 of said printed circuit board 20, while a second outer diameter defined by said chamfered ends 15*a* is smaller than said hole 21 of said printed circuit board 20.

When the chamfered ends 15*a* are inserted into said hole 21 of said printed circuit board 20, the outer wall 15*b* of the mounting leg 15 will deflect and abut against an upper edge 21*a* of the hole 21. When the mounting leg 15 moves further into the hole 21, the outer wall 15*b* of the mounting leg 15 will tightly abut against an inner wall 21*b* of the hole 21. The deflection of the mounting legs 15 is benefited by the gap 16 formed therebetween.

In order to increase the frictional contact between the outer wall 15*b* of the mounting legs 15 and the inner wall 21*b* of the hole 21, each said mounting leg 15 further includes a bud 15*c* facing a corresponding bud 15*c* of another mounting leg 15. These two buds 15*c* will abut to each other when half of the mounting legs 15 are inserted into the hole 21.

By this arrangement, the guiding post 14 can also serve as a locking device which fixedly and reliably attaches a connector to the printed circuit board 30.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical system, comprising:

a printed circuit board having at least a pair of mounting holes;

a connector including a housing with a pair of flanges extending outward from said housing, said housing defining an elongate slot with a plurality of terminal passageways formed in inner walls of said slot; and a pair of guiding post extending downward from said flanges, each guiding post including a pair of mounting legs spaced apart from each other with a gap therebetween, each mounting leg including a bud facing a corresponding bud of another mounting leg;

wherein each mounting leg including a chamfered end to guide said mounting leg into said hole defined in the printed circuit board.

2. The electrical system as recited in claim 1, wherein said mounting legs jointly define a first outer diameter which is larger than said hole of said printed circuit board, while a second outer diameter defined by said chamfered ends is smaller than said hole of said printed circuit board.

3. The electrical system as recited in claim 2, wherein said chamfered ends are pushed toward each other when said chamfered ends extend into said hole of said printed circuit board.

4. The electrical system as recited in claim 1, wherein said buds abut each other thereby limiting deflection of said mounting legs and increasing frictional contact between said mounting legs and said hole.

5. A retention system comprising:

a printed circuit board defining a mounting hole therein;

a guiding post integrally extending downward from an insulative housing of a connector mounted on the printed circuit board;

said guiding post including a pair of mounting legs spaced from each other with a gap therebetween;

a pair of buds integrally formed on free ends of the corresponding mounting legs, respectively, said pair of buds positioned in the gap opposite to each other, wherein the guiding post is received within the mounting hole, and said pair of mounting legs are deflected inwardly with the free ends of the mounting legs moving toward each other and having the corresponding buds abut against with each other.

* * * * *